United States Patent [19]

Lorenz

[11] Patent Number: 4,573,314

[45] Date of Patent: Mar. 4, 1986

[54] YARN WETTING DEVICE PARTICULARLY FOR USE IN A TWO-FOR-ONE TWISTER

[75] Inventor: Rainer Lorenz, Nettetal-Breyell, Fed. Rep. of Germany

[73] Assignee: Palitex Project-Company GmbH, Krefeld, Fed. Rep. of Germany

[21] Appl. No.: 710,867

[22] Filed: Mar. 12, 1985

[30] Foreign Application Priority Data

Mar. 14, 1984 [DE] Fed. Rep. of Germany ..... 3409233

[51] Int. Cl.[4] ..... D01H 1/10; D01H 13/30; B05C 1/06

[52] U.S. Cl. ..... 57/296; 57/58.83; 57/58.86; 118/234; 118/264; 118/DIG. 22

[58] Field of Search ..... 57/295–298, 57/58.83, 58.86, 58.49; 118/234, 264–267, DIG. 18–DIG. 22; 87/1, 23; 28/178

[56] References Cited

U.S. PATENT DOCUMENTS

| | | | |
|---|---|---|---|
| 1,734,293 | 11/1929 | Hellweg | 118/234 |
| 1,802,602 | 4/1931 | Hellweg | 118/234 |
| 2,525,997 | 10/1950 | Beier | 118/234 X |
| 3,295,305 | 1/1967 | Nimtz | 57/58.49 |
| 3,400,528 | 9/1968 | Nimtz et al. | 57/296 X |
| 3,423,922 | 1/1969 | Smith | 57/296 |
| 3,474,756 | 10/1969 | Van Dijk | 57/296 X |
| 3,848,565 | 11/1974 | Schweppe | 118/234 |
| 3,864,901 | 2/1975 | Beymes et al. | 57/296 |
| 4,311,114 | 1/1982 | Lees et al. | 118/234 X |
| 4,334,404 | 6/1982 | Franzen | 57/58.83 X |
| 4,380,891 | 4/1983 | Wehrmeister | 57/58.49 X |

OTHER PUBLICATIONS

"Chemiefasern/Textillindustrie," 27/79 (1977), 1018–1021.

*Primary Examiner*—John Petrakes

*Attorney, Agent, or Firm*—Bell, Seltzer, Park & Gibson

[57] ABSTRACT

A yarn wetting device, particularly for a two-for-one twisting spindle assembly, has a reservoir and a porous member which has capillary action and over which yarn is drawn for the purpose of receiving wetting agent or the like which is fed from below by suction from the reservoir to the porous body. In order to ensure uniform transfer of the wetting agent, irrespective of the level of the wetting agent in the reservoir, a line system leads into the reservoir and has an opening which opens into the atmosphere above the reservoir and an opening located at a distance above the bottom of the reservoir, and the reservoir is sealed relative to the atmospheric pressure when the level of the wetting agent in the reservoir is above the bottom opening of the line system.

24 Claims, 11 Drawing Figures

YARN WETTING DEVICE PARTICULARLY FOR USE IN A TWO-FOR-ONE TWISTER

FIELD OF THE INVENTION

The invention relates to a yarn wetting device having a reservoir and a porous body which has a capillary action and along which is drawn the yarn for the purpose of receiving wetting agent or the like which is fed from the reservoir.

The invention also relates to a two-for-one twisting spindle having a porous body of revolution which has a capillary action and is mounted on that end of the hollow axle which extends above the yarn supply package, and along which body of revolution the yarn running off the feed bobbin and into the hollow axle of the spindle is drawn for the purpose of receiving wetting agent or the like which is fed to the body of revolution from a reservoir which is mounted in the region of the top end of the bobbin carrier.

BACKGROUND OF THE INVENTION

A yarn wetting device and a two-for-one twisting spindle provided with a yarn wetting device is described in, for example, U.S. Pat. No. 3,864,901, issued Feb. 11, 1975 and in the publication "Chemiefasern-/Textillindustrie" 27/79 (1977), 1018–1021.

An essential part of such wetting device is a wetting body in the form of a porous body having a capillary action and disposed to absorb wetting agent or lubricant directly from the reservoir and/or additionally by way of a wick system. The yarn is drawn over the wetting body and thereby receives lubricant or wetting agent. The wetting agent or lubricant diffuses into and through the wetting body as a result of capillary forces and forms a thin film of liquid or lubricant on that surface of the wetting body which faces the yarn. The equilibrium in the wetting body capillary system is changed when the yarn removes this film, and fresh lubricant or wetting agent is conveyed to the surface. This operation takes place continuously. As a result of this physical principle, the lubricating unit cannot drip in the event of the breakage of the yarn or stoppage of the machine.

The conveying of lubricant by capillary forces makes the lubricating system dependent upon various factors, such as the chemical constitution and viscosity of the lubricant or wetting agent, average size of pore and distribution of the size of pores in the wetting body, and the level in the reservoir.

OBJECT AND SUMMARY OF THE INVENTION

An object of the invention is to construct a yarn wetting device such that the conveyance of wetting agent or lubricant remains as uniform as possible in order to maintain the quantity of wetting agent or lubricant supplied to the wetting body, and hence the quantity of wetting agent transferred to the yarn, largely constant even when the level of the wetting agent or lubricant in the reservoir is dropping.

A yarn wetting device in accordance with the invention has a reservoir, a porous member which has absorbent and capillary qualities and over which the yarn is drawn for the purpose of removing wetting agent or the like which is fed from the reservoir to the porous body by suction, and a line system which leads into the reservoir and has an opening which opens into the atmosphere above the reservoir and an opening located at a distance above the bottom of the reservoir, the reservoir being sealed relative to the atmospheric pressure when the level of the wetting agent is above the bottom opening of the line system.

A device of this kind chiefly uses the principle of the "Mariotte bottle" into which a tube, open at both ends, is inserted from above in an air-tight manner. When the bottom opening of this tube is located at a specific height above an outlet opening, atmospheric pressure always prevails at the level of this bottom opening, and fluid flowing out is always under a constant pressure and has a constant velocity provided that the tube is located below the surface of the liquid. A function of this tube is to transfer the constant atmospheric pressure from the surface of the liquid, to a location below the surface of the liquid.

Referring to the device in accordance with the invention, the outlet opening of the "Mariotte bottle" corresponds to the inlet opening of the feed line to the porous body or possibly to the contact surface between the porous body and the liquid if a separate feed system is not provided.

Another explanation of the basic principle can be derived from the known working principle of the so-called "bird or poultry drinking tray or trough" in which an inverted dish is placed onto a pot filled with liquid and is centered in, for example, the center of the pot. When this unit which comprises the pot and the dish, and which is filled with liquid, is inverted, the rim of the pot then being at the bottom and held at a certain distance from the bottom of the dish, liquid runs out of the pot to a specific level in the dish. The residual fluid remains in the inverted pot and its level is higher than the level of the liquid which has run out of the pot into the dish. A vacuum space is formed above the liquid column in the pot which is now sealed relative to the atmospheric pressure. A pressure is established in this vacuum space and holds the additional liquid column relative to the atmospheric pressure and gravity.

The additional liquid column is the difference between the level of the liquid in the dish and in the level of the liquid in the liquid container or pot which is hermetically sealed relative to the atmospheric pressure. When animals or birds take water from the dish, an air bubble between the level of the liquid in the dish and the bottom rim of the pot enters the vacuum space of the liquid container or pot for further equalization of pressure whenever the liquid level in the dish tends to drop below the rim of the pot as a result of water being taken from the dish. A fresh level between the vacuum space and liquid column is then established, under changed pressure conditions, in the liquid container or pot which is sealed relative to the outer atmosphere, while the outer surface of the liquid always remains at the same level irrespective of the removal of water.

BRIEF DESCRIPTION OF THE DRAWINGS

The invention will be further described, by way of example, with reference to the accompanying drawings, in which.

DETAILED DESCRIPTION OF PREFERRED EMBODIMENTS OF THE INVENTION

Figure 1:
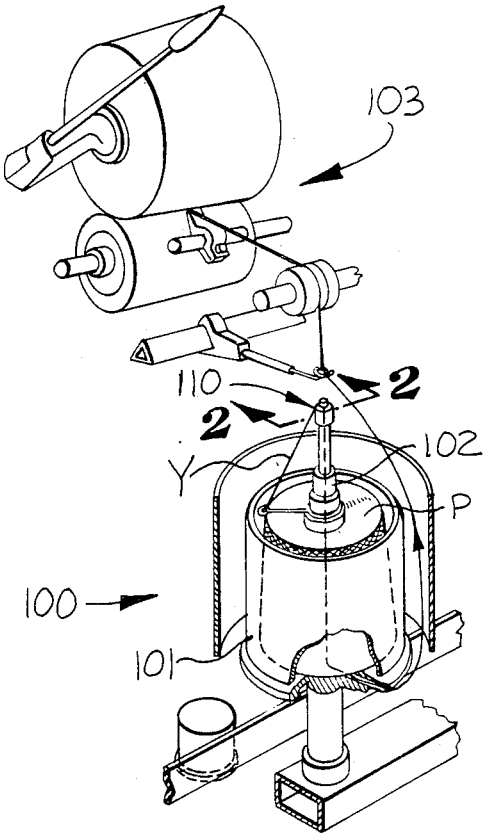
FIG. 1 is a perspective view, partially broken away, of a portion of one spindle assembly of a two-for-one twister textile yarn processing machine utilizing the yarn wetting device of this invention.

Referring now to the drawings, there is illustrated in FIG. 1, a schematic, perspective view of a single spindle assembly station, generally indicated at 100, of a two-for-one twister textile yarn processing machine utilizing the yarn wetting device, generally indicated at 110, of this invention. It is to be understood that a plurality of these spindle assembly stations are provided in which the spindle assembly stations are arranged in side-by-side relationship in two rows along the outside of the machine. While the yarn wetting device 110 of this invention is particularly adaptable for use in combination with a two-for-one twister textile yarn processing machine, such yarn wetting device 110 could also be utilized with other machines.

The spindle assembly 100 of the two-for-one twister generally includes a carrier mechanism 101 for carrying a hollow supply package P of yarn Y and a hollow axle device 102 extending through the carrier mechanism for receiving the traveling yarn Y from the supply package P during processing in the spindle assembly 101. The yarn passes from the carrier mechanism 101 and the hollow spindle device 102 to a take-up mechanism 103 in a well-known manner and a two-for-one twist is inserted into the yarn during such processing. A full illustration and description of the entire two-for-one twister is not given herein and is not believed to be necessary for an understanding of the present invention, the operation and construction of such a two-for-one twister is well understood by those with ordinary skill in the art.

Figure 2:
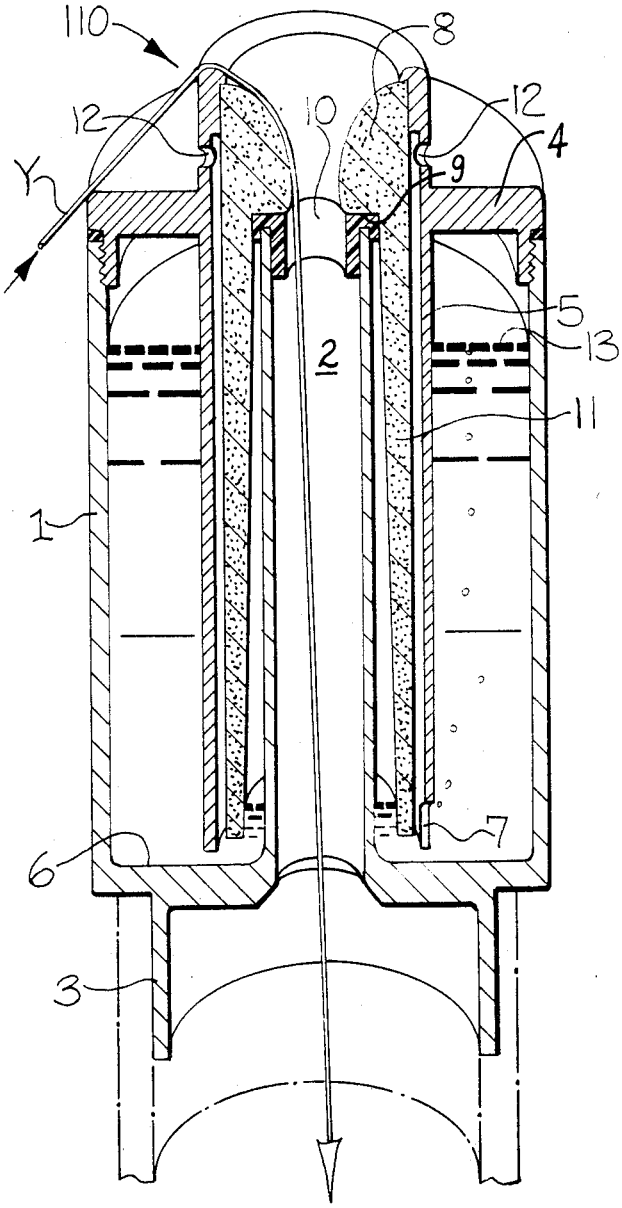
FIGS. 2 to 6 are axial sections through various embodiments of the yarn wetting device in accordance with the invention.

Referring now to the various embodiments of the yarn wetting device 110, the first embodiment illustrated in FIG. 2 operates in accordance with the principle of a "poultry drinking tray" as described above. This FIG. 2 is an axial section through an annular reservoir 1 whose central tube 2 is in line with the hollow axle 102 of a spindle assembly 100 of a two-for-one twister when the wetting device is used in conjunction with a two-for-one twisting spindle assembly 100. A device in the form of, for example, an annular flange 3 is formed on the underside of the reservoir for the purpose of securing the yarn wetting device on, or slipping it onto, the top end of the hollow axle 102 of the spindle assembly 100.

The reservoir is closed by means of an annular cover 4 carrying a central tube 5 which has the function of the above-described open-ended dip tube of a "Mariotte bottle". The bottom opening of the central tube is located at a relatively short distance from the bottom 6 of the reservoir and, in accordance with a preferred embodiment of the invention, its bottom end is provided with a lateral slot 7. An annular wetting body 8 in the form of a solid body of revolution and made from porous material so as to have a capillary action is inserted into the tube 5. That surface of the wetting body which faces the yarn has an inwardly directed, rounded surface and is sealingly secured in the top end of the tube 5 which has an inwardly directed thickened portion at this location. The wetting body 8 has below its rounded surface a support shoulder 9 by which the wetting body is mounted on the top rim of the central tube 2 of the reservoir 1 with a sealing member 10 interposed therebetween. An annular extension or skirt 11 surrounding the tube 2 is downwardly contiguous to the actual wetting region of the wetting body 8 and its bottom end also terminates at a relatively short distance above the bottom 6 of the reservoir, although it is lower than the top edge of the slot 7 and, according to a further embodiment, the annular extension 11 can extend lower than the bottom edge of tube 5.

A free annular space is located between the outer circumference of the skirt 11 and the interior wall of the central tube 5, such that communication with the outer atmosphere and the interior space of the reservoir 1 is established by air inlets 12 provided at the top end of the tube 5.

The central tube 5 forms a line system leading into the reservoir 1. It is ensured that the reservoir is sealed relative to the outer atmosphere when the level of the lubricant or wetting agent 13 introduced into the reservoir 1 is above the bottom opening of the tube 5. When a yarn Y is drawn along the upper rounded wetting surface of the wetting body 8, the yarn Y removes wetting agent from the wetting surface, so that the equilibrium in the wetting body capillary system and in the pressure system of the reservoir is changed. On the one hand, a vacuum is thereby built up above the surface of the wetting agent in the annular reservoir 1, while, on the other hand, the equilibrium in the wetting body capillary system is changed and fresh wetting agent 13 or lubricant is conveyed to the upper rounded wetting surface. At the same time, the level of the wetting agent 13 within the central tube drops in accordance with the principle of the "Mariotte bottle", namely to the level of the bottom opening of the tube 5 or to the level of the lateral slit 7, if such a slit is provided. Upon further removal of wetting agent 13 in the region of the rounded wetting surface of the wetting body 8, the level of wetting agent 13 within the central tube 5 drops until air bubbles enter the annular reservoir 1 through the slit 7, whereby equilibrium between the vacuum above the surface of the wetting agent 13 and the capillary system is established.

Hence, in accordance with the embodiment of FIG. 2, the vacuum space located in the upper region of the reservoir 1 is separated from the wetting body 8 of the wetting device by the tube 5. The bottom region of the wetting body 8, made from capillary-active plastics material, is located in a column of wetting agent of predetermined height. Hence, wetting agent 13 is supplied in the region of the upper rounded wetting surfaces of the wetting body 8 irrespective of the level in the reservoir 1, so that the application of wetting agent 13 to the yarn Y drawn over the wetting surfaces also remains substantially constant.

Figure 3:
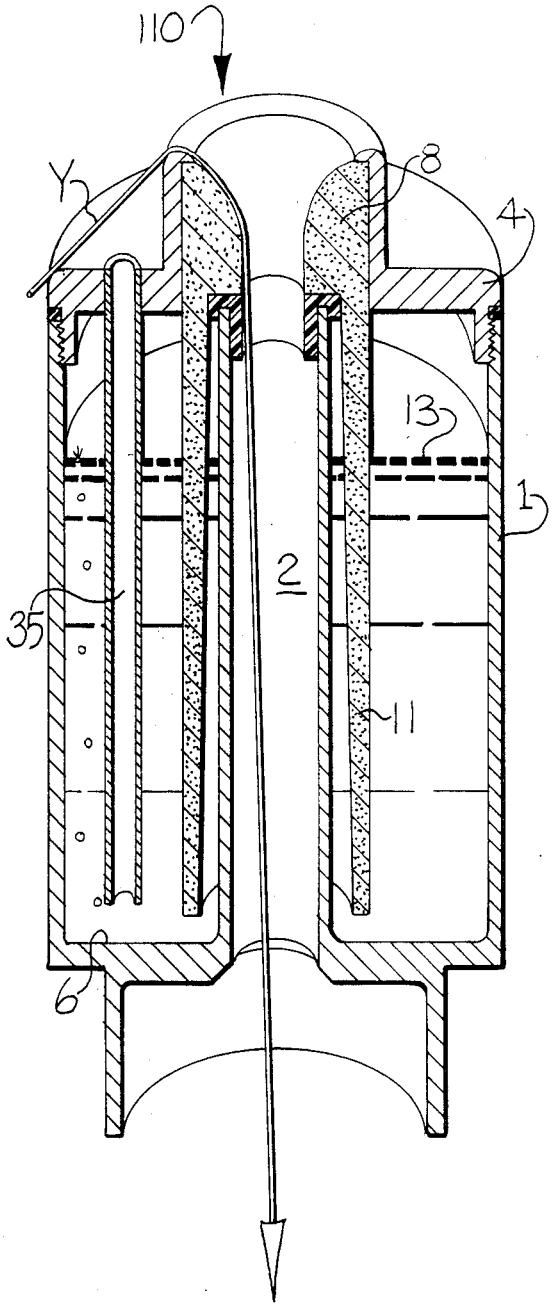

In the embodiment of FIG. 3, pressure equalization between a sealed reservoir 1 and the atmospheric pressure is effected by way of a tube 35 which extends to the vicinity of the bottom 6 of the reservoir 1 and which is located laterally of, and adjacent to, the central tube 2 of the reservoir and the skirt 11 of the porous wetting body 8. Although the wetting body 8 or its skirt 11 extends directly into the wetting agent 13 in this embodiment, and hence is immersed to differing depths into the wetting agent 13 in dependence upon the decreasing level, it is also ensured in the present instance that, despite differing depths of immersion, always the same quantity of wetting agent 13 is conveyed by capillary action to the rounded wetting surface of the wetting member 8 across which the yarn Y is drawn, so that the quantity of wetting agent 13 received by the yarn Y also remains constant. The reason for this resides in the vacuum space provided above the surface of the wetting agent 13.

In order to improve comprehension of the working principle of the embodiment of FIG. 3, let it be imagined that an individual capillary tube is immersed in the closed "poultry drinking tray system" and terminates just below the surface of the liquid. In this case, the (negative hydrostatic) pressure at the removal point (wetting point for the yarn) of the capillary tube corresponds to the pressure of the liquid column up to the removal level, plus the air pressure (excess pressure) which acts upon the liquid column and which is reduced relative to the atmospheric pressure precisely by the pressure necessary to raise the liquid column in the closed reservoir relative to the level of the liquid subjected to atmospheric pressure. The sum of the pressures of the additional liquid column in the reservoir and the pressure of the space above the liquid column always corresponds to the atmospheric pressure. Hence, it is ensured that the wetting body 8 always supplies the same quantity of wetting agent 13 or brightening agent to the yarn despite the differing depths of immersion of the skirt 11.

Figure 4:
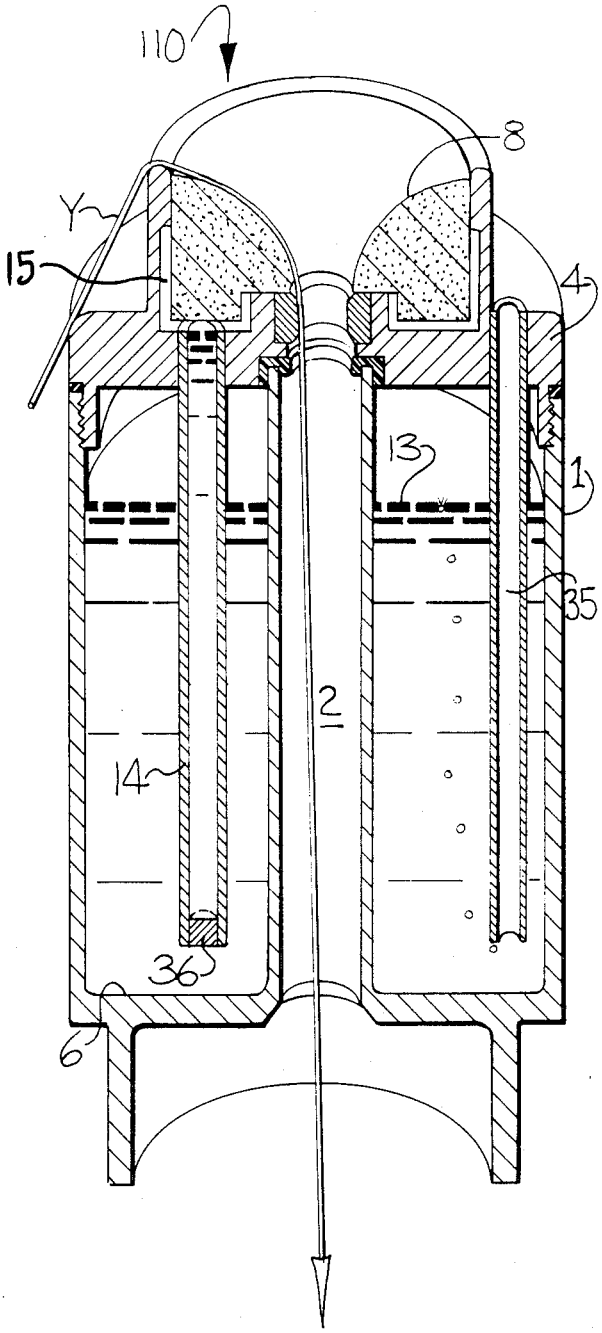

In the embodiment of FIG. 4, the actual wetting body 8 does not have the annular extension or skirt which, as shown in FIGS. 2 and 3, is immersed in the wetting agent 13, and the actual wetting body 8 is disposed above the cover 4. A siphon tube 14 extends into the closed reservoir 1 and its top end opens into a space 15 which is closed by the wetting body 8. Provided that the siphon tube 14 is initially filled with wetting agent as well as the space 15 below the wetting body 8 including the wetting body 8 itself, and that the siphon is not broken, the system of FIG. 4 operates on the same principle as that of the embodiment of FIG. 3, the same explanations also being applicable. The important feature of the embodiment of FIG. 4 is that not only is the reservoir 1 sealed relative to the atmospheric pressure, but also the space 15 between the top end of the siphon tube 14 and the wetting body 8.

Figure 5:
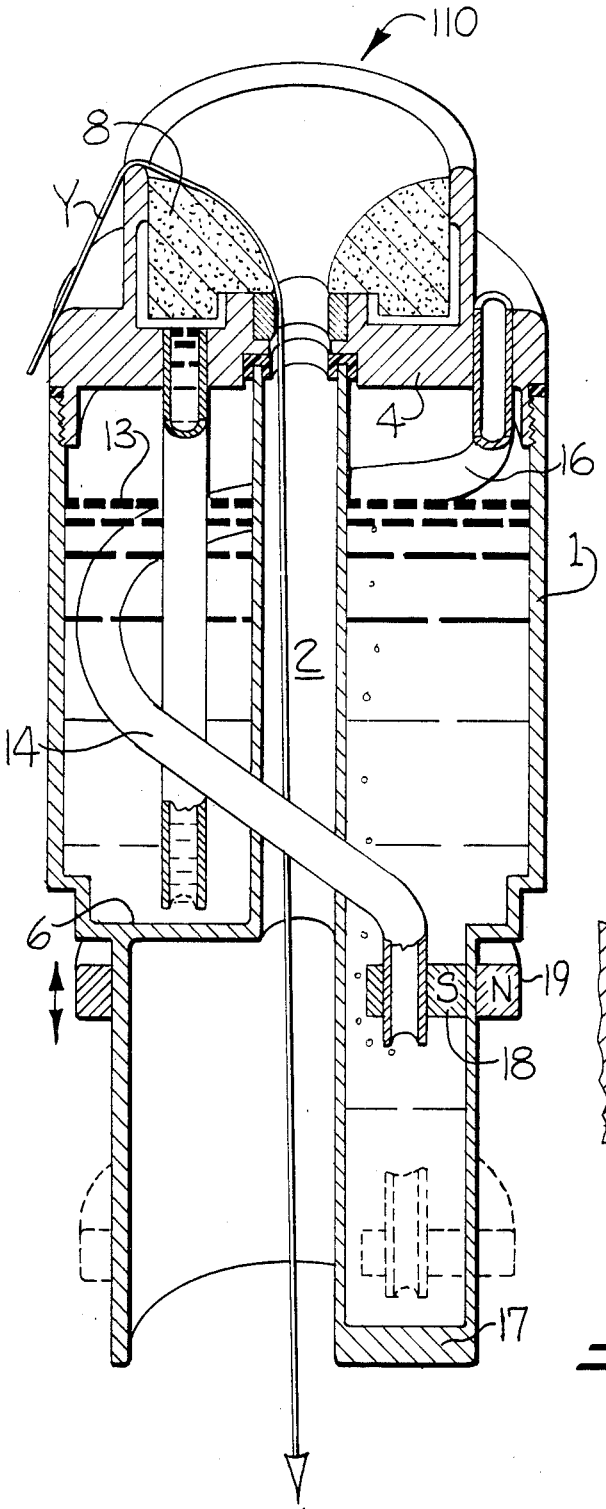

FIG. 5 concerns the possibility of metering the quantity of wetting agent 13 supplied to the yarn Y. For this purpose, the line system communicating with the outer atmosphere is in the form of a flexible line 16 whose bottom open end enters a reservoir extension 17 extending below the bottom 6 of the reservoir 1 and is fixable in different vertical positions. A preferred possibility of varying the vertical position of the bottom end of the line resides in that this bottom end of the line carries a permanent magnet 18 having an associated countermagnet 19 displaceable outside the reservoir extension 17. A smaller quantity of wetting agent 13 is supplied to the wetting body 8 by lowering the bottom end or open end of the flexible tube 16, and vice versa. It is assumed that the quantity of wetting agent 13 in the reservoir extension 17 is negligible relative to the total quantity of wetting agent in the reservoir 1, in order to ensure that almost the entire quantity of wetting agent 13 is always supplied under constant pressure conditions irrespective of the dosage which has been set. In accordance with a preferred embodiment, this is achieved structurally in that the reservoir extension 17 has an internal diameter which is only slightly greater than the diameter of the flexible tube 16. As in the case of the metering systems which will be described hereinafter with reference to FIGS. 6 and 9, the construction of the suction or capillary system is irrelevant to the metering system illustrated in FIG. 5, that is to say, it is irrelevant whether the suction system is constructed in accordance with FIGS. 2 and 3 on the one hand or FIG. 4 on the other hand.

Figure 6:
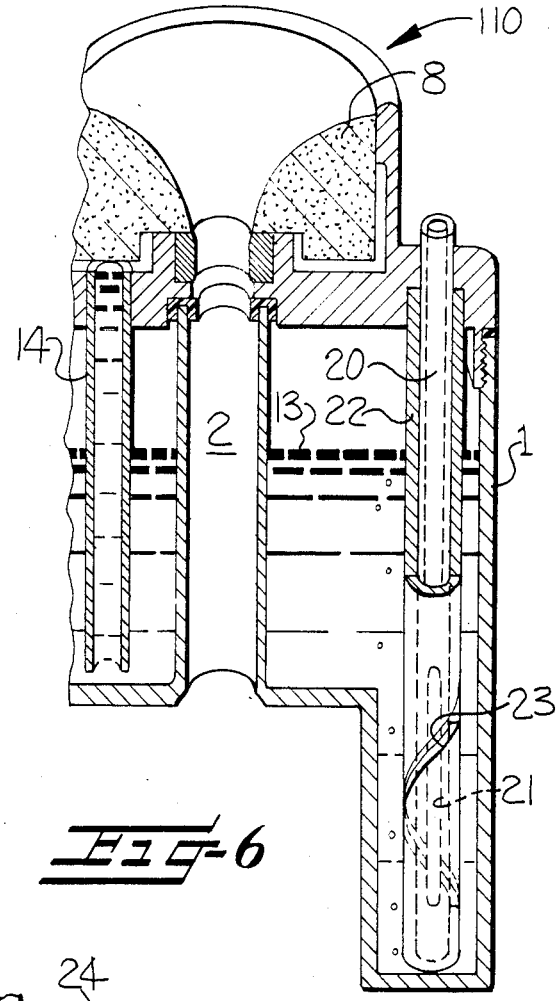
Figure 7:
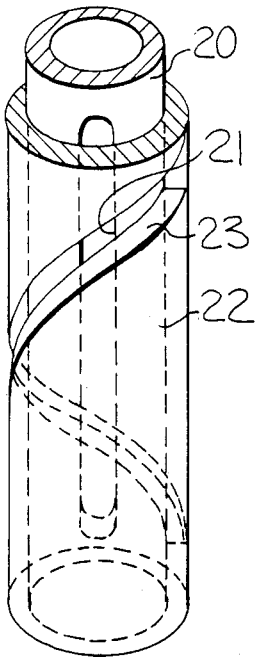
FIG. 7 is a sectional detail, drawn to a larger scale, of the embodiment illustrated in FIG. 6.

FIGS. 6 and 7 show modified embodiments of a metering system. The line system communicating with the atmospheric pressure comprises a dip tube 20 whose bottom end is closed and whose wall is provided with a longitudinal slot 21 parallel to its axis and which is sealingly fitted in a tubular sleeve 22. The tubular sleeve is provided with a preferably spiral slot 23 which intersects the longitudinal slot 21 of the dip tube 20, such that the point of intersection between the two slots 21, 23 is vertically adjustable upon rotating the dip tube or the tubular sleeve about its longitudinal axis. The overlap of the two slots always occurs in only a small region of intersection, such that the atmospheric pressure prevails in the interior of the reservoir only at the level at which the two slots overlap. Hence, the relevant pressure head can be varied, so that differing quantities of wetting agent are also applied to the yarn.

In accordance with a modified embodiment of the invention the slot in the dip tube can be spiral shaped, and the slot in the tubular sleeve can extend parallel to its axis.

Figure 8:
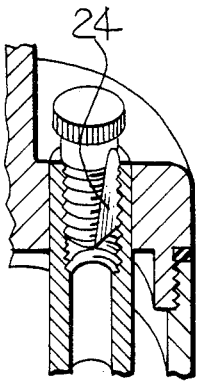
FIG. 8 is an axial detail section of metering means for the wetting agent.

When the wetting agent 13 is supplied to the yarn Y at a very high rate, the air flows out of the atmospheric region relatively rapidly into the closed reservoir 1. This forms the basis of an additional possibility of regulating the quantity of wetting agent 13 supplied. In accordance with FIG. 8, the cross section of the top opening, opening into the outer atmosphere, of the line system is to be variable by, for example, associating with the line system a rotatable closure plug 24 which allows the air to flow into the line system only by way of a throttling gap.

Figure 9:
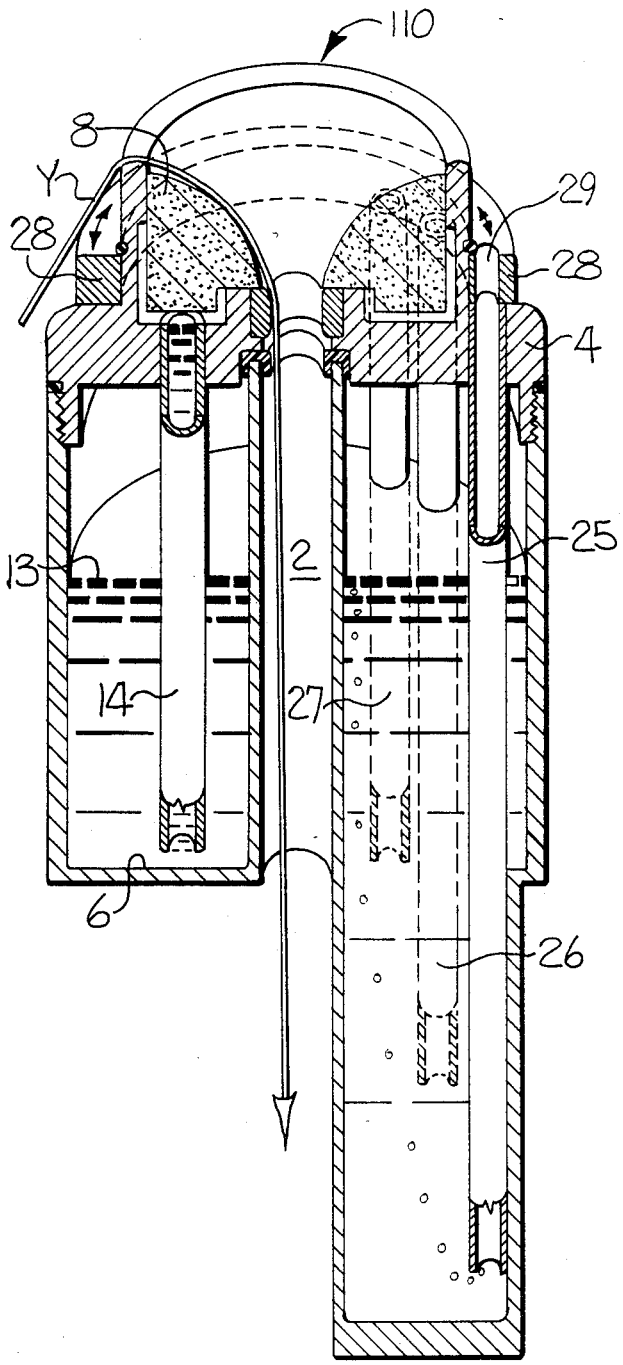
FIG. 9 is an axial section of a further embodiment of yarn wetting device.

FIG. 9 shows a further metering system in which the line system, open towards the outer atmosphere at one end and opening into the reservoir 1 at the other end, comprises a plurality of dip tubes 25, 26 and 27 of different lengths whose top openings are in each case closable with the exception of one. For this purpose, an adjustable or rotatable closure member 28 is provided above the cover 4 of the reservoir and has an opening 29 which is connectible to a selected one of the dip tubes.

It follows from the above description that the suction or siphoning system should, as far as possible, be filled permanently with wetting agent 13, since, otherwise, the entire system would first have to be refilled when refilling the reservoir in order to maintain the operation for the delivery of wetting agent 13 to the wetting body 8 under the various pressure conditions from the outset. Therefore, in the cases illustrated hitherto, the siphon tube of FIG. 4 is shorter than the line system communicating with the atmospheric pressure, insofar as the depth of the immersion into the wetting agent is concerned. In accordance with a further feature of the invention, in order to provide a certain safeguard against the system being emptied to too great an extent, the bottom opening of the suction tube is to be closed by a thin disc or diaphragm 36 of porous material having a capillary action.

The throttling action of the porous diaphragm is to be chosen such that the capillary action of the wetting body 8 alone cannot overcome the resistance of the throttle. The throttling action of the diaphragm 36 is overcome only when the liquid column in the reservoir and the vacuum column above the surface of the wetting agent 13 are present in the system again.

Figure 10:
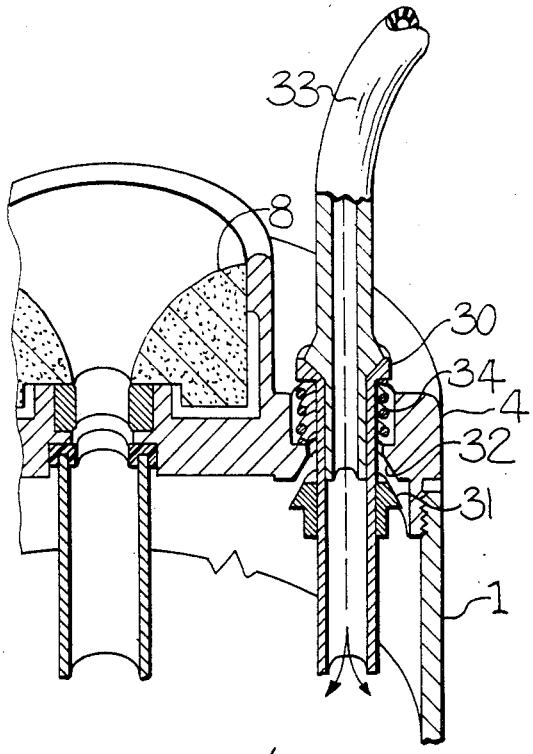
FIGS. 10 and 11 are partial axial detail sections of means for the trouble-free introduction of wetting agent into the reservoir.
Figure 11:
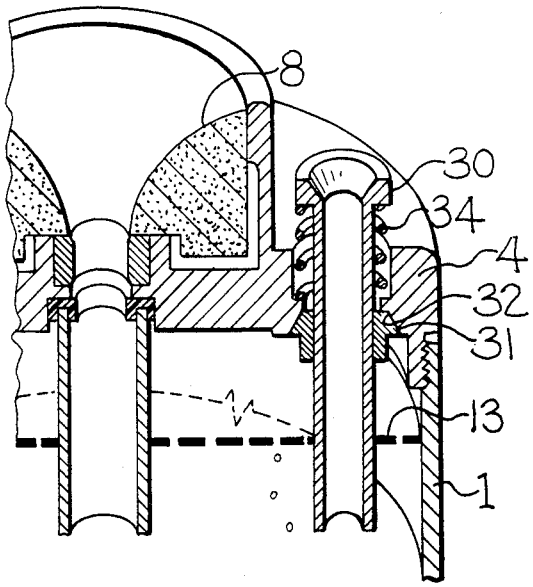

FIGS. 10 and 11 relate to the filling of the reservoir 1. In accordance with this embodiment of the invention, the filling of the reservoir is facilitated by at the same time using for this purpose the line system which opens at one end towards the atmosphere and at the other end opens into the reservoir 1.

In accordance with FIGS. 10 and 11, the line system has in the region of its top opening a tubular member 30 which can be pressed into the reservoir 1 against the force of a spring 34 and which is provided with a valve closure element 31 located within the reservoir 1 and cooperable with an associated valve seat 32 in the cover 4 of the reservoir. For the purpose of filling the reservoir, a filler piece 33, connected to a supply source (not illustrated), is mounted on the top end of the tubular member 30 and is at the same time pressed downwardly. The valve closure element 31 is separated from the valve seat 32 when the tubular member 30 is pressed downwardly, so that air can flow out of the reservoir 1 when wetting agent 13 flows into the reservoir 1. The filler piece 33 is removed from the tubular member 30 upon completion of the filling operation, so that tubular member 30 is pushed upwardly by the compression spring 34, the valve, comprising the valve closure element 31 and the valve seat 32, at the same time being closed.

When the wetting agent 13 commences to be consumed, the liquid column within the line system will drop in the first instance until the level of the wetting agent 13 within the line system reaches the bottom edge of the tube. The pressure-equalization cycle described above commences from this instant onwards.

In the drawings and specification there have been set forth preferred embodiments of this invention and, although specific terms are employed, they are used in a generic and descriptive sense only and not for purposes of limitation.

What is claimed is:

1. A device for applying a wetting agent to traveling yarn and characterized by the conveyance of a uniform quantity of wetting agent to the yarn even when the amount of wetting agent in said device is reducing; said device comprising:

a reservoir carrying a supply of wetting agent at varying levels therein;

a yarn wetting means including a porous member having absorbent and capillary qualities and over which the yarn travels for removing wetting agent, and suction means positioned in said reservoir below the wetting agent level for feeding the wetting agent by suction from said reservoir to said wetting member;

line system means leading into said reservoir and having an upper opening which opens into the atmosphere above said reservoir and a bottom opening located at a predetermined distance above the bottom of said reservoir which opens into the wetting agent; and said reservoir, said line system and the wetting agent cooperating to provide means for sealing said reservoir relative to atmospheric pressure when the level of the wetting agent in said reservoir is above said bottom opening of said line system means and for transferring constant atmospheric pressure from the surface of the wetting agent to a location below the surface of the wetting agent to ensure that a uniform quantity of wetting agent is fed by said suction means from said reservoir to said wetting member as the traveling yarn removes the wetting agent.

2. A device, as set forth in claim 1, in which said suction means of said wetting means comprises a downwardly-extending annular extension of said wetting member and having absorbent and capillary qualities.

3. A device, as set forth in claim 2, in which said wetting member and said downwardly-extending annular extension thereof are of the same material and integrally formed.

4. A device, as set forth in claim 1 or 2, in which said line system means comprises a tube positioned centrally of said reservoir, and in which said suction means of said wetting means extends substantially into the vicinity of the bottom of said reservoir.

5. A device, as set forth in claim 4, in which the bottom end of said tube includes a lateral slot therein forming said bottom opening of said line system means.

6. A device, as set forth in claim 5 in which said suction means extends below said bottom opening of said line system means.

7. A device for applying a wetting agent to traveling yarn and characterized by the conveyance of a uniform quantity of wetting agent to the yarn even when the amount of wetting agent in said device is reducing; said device comprising:

a reservoir carrying a supply of wetting agent at varying levels therein;

a yarn wetting means including a porous member having absorbent and capillary qualities and over which the yarn travels for removing wetting agent and suction means comprising a downwardly-extending annular extension of said wetting member formed integrally therewith and of the same material for having absorbent and capillary qualities and being positioned in said reservoir to extend substantially into the vicinity of the bottom of said reservoir below the wetting agent level for feeding the wetting agent by suction from said reservoir to said wetting member;

line system means comprising a tube leading into said reservoir and having an upper opening which opens into the atmosphere above said reservoir and a bottom opening located at a predetermined distance above the bottom of said reservoir which opens into the wetting agent at a point above the bottom of said annular extension of said wetting member; and said reservoir, said line system and the wetting agent cooperating to provide means for sealing said reservoir relative to atmospheric pressure when the level of the wetting agent in said reservoir is above said bottom opening of said line system means and for transferring constant atmospheric pressure from the surface of the wetting agent to a location below the surface of the wetting agent to ensure that a uniform quantity of wetting agent is fed by said suction means from said reservoir to said wetting member as the traveling yarn removes the wetting agent.

8. A yarn wetting device, as set forth in claim 1 or 7, in which said line system means is positioned centrally of said reservoir.

9. A yarn wetting device, as set forth in claim 1, 2, 3 or 7, in which said line system extends into said reservoir laterally of and adjacent to said suction means of said wetting member.

10. A yarn wetting device as set forth in claim 1, in which said suction means of said wetting means comprises siphon tube means extending from said wetting member substantially into said reservoir.

11. A yarn wetting device, as set forth in claim 10, in which said siphon tube extends into the vicinity of the bottom of said reservoir and said bottom opening of line system means is positioned below the bottom opening of said siphon tube.

12. A yarn wetting device, as set forth in claim 10, in which said wetting means further includes an enclosed chamber positioned between said siphon tube means and said wetting member and communicating with said wetting member for receiving wetting agent from said siphon tube and supplying the wetting agent to said wetting member.

13. A device for applying a wetting agent to traveling yarn and characterized by the conveyance of a uniform quantity of wetting agent to the yarn even when the amount of wetting agent in said device is reducing; said device comprising:

a reservoir carrying a supply of wetting agent at varying levels therein;

a yarn wetting means including a porous member having absorbent and capillary qualities and over which the yarn travels for removing wetting agent, a siphon tube means extending from said wetting member substantially into the vicinity of the bottom of said reservoir below the wetting agent level for feeding the wetting agent by suction from said reservoir toward said wetting member, and an enclosed chamber positioned between said siphon tube means and said wetting member and communicating with said wetting member for receiving wetting agent from said siphon tube and supplying the wetting agent to said wetting member;

line system means comprising a tube leading into said reservoir and having an upper opening which opens into the atmosphere above said reservoir and a bottom opening located at a predetermined distance above the bottom of said reservoir which opens into the wetting agent at a point below the bottom opening of said siphon tube; and said reservoir, said line system and the wetting agent cooperating to provide means for sealing said reservoir relative to atmospheric pressure when the level of the wetting agent in said reservoir is above said bottom opening of said line system means and for transferring constant atmospheric pressure from the surface of the wetting agent to a location below the surface of the wetting agent to ensure that a uniform quantity of wetting agent is fed by suction from said reservoir to said wetting member as the traveling yarn removes the wetting agent.

14. A yarn wetting device, as set forth in claim 10 or 13, in which said siphon tube means includes a diaphragm of porous material having capillary qualities positioned in the bottom opening of said siphon tube for throttling the flow of wetting agent from said reservoir through said siphon tube to said wetting member.

15. A device, as set forth in claim 1, in which said line system means includes means for vertically adjusting the position of said bottom opening of said line system means.

16. A device, as set forth in claim 15, in which said reservoir includes a downwardly-extending extension from a portion of the bottom of said reservoir, and in which said bottom opening of said line system means is positioned in said reservoir extension.

17. A device, as set forth in claim 15 or 16, in which said line system means comprises a flexible tube, and in which said vertically adjusting means for said bottom opening of said line system means comprises magnet means attached to a bottom portion of said flexible tube and cooperating magnet means positioned outside said reservoir and vertically movable along the outside of said reservoir.

18. A device, as set forth in claim 15 or 16, in which said line system means comprises a dip tube closed at the bottom end thereof and having a longitudinal slot in generally a bottom portion of the wall thereof, and a tubular sleeve sealingly receiving therein for relative rotation said dip tube and having a slot in generally a bottom portion of the wall thereof which intersects said longitudinal slot in said dip tube to form said bottom opening in said line system means and which has a configuration such that the point of intersection of said two slots is vertically adjustable upon rotation of one of said dip tube or tubular sleeve relative to the other.

19. A device, as set forth in claim 18, in which said slot in one of said dip tube or said tubular sleeve is a longitudinally-extending slot and said slot in the other of said dip tube or said tubular sleeve is a spiral slot.

20. A device, as set forth in claim 15 or 16, in which said line system means comprises a plurality of dip tubes of differing lengths, and means for selectively opening and closing the top openings each of said dip tubes to form said upper opening of said line system means.

21. A device, as set forth in claim 20, in which said means for selectively opening and closing the top openings of said dip tubes comprises an adjustable closure member positioned on the top of said reservoir and having one opening selectively connectable to a respective one of said dip tubes.

22. A device, as set forth in claim 1, 2 or 10, including means positioned in said upper opening of said line system means for varying the cross-section of said upper opening.

23. A device, as set forth in claim 1, 2 or 10, in which said line system means includes a tubular member movably mounted in and extending out of the top of said reservoir and forming said upper opening in said line system means, means for biasing said tubular member toward an outwardly-extending position from said reservoir, and valve means connected between said tubular member and the top of said reservoir for being closed to close said reservoir to the outside atmosphere when said tubular member is in its biased outwardly-extending position and for being opened when said tubular member is moved inwardly against said biasing means to open said reservoir to the outside atmosphere; and in which said device includes means for filling said reservoir with wetting agent comprising a wetting agent supply line having a tubular member on the end thereof adapted to be inserted in and move said tubular member of said line system means to an inward position against said biasing means to open said valve means and fill said reservoir with wetting agent.

24. A two-for-one twister textile yarn processing machine having spindle assemblies each including a carrier mechanism for carrying a hollow supply package of yarn and hollow axle means extending through said carrier mechanism for receiving traveling yarn from the supply package during processing in said spindle assembly; and the combination therewith of a device mounted on the top of said hollow axle means for applying a wetting agent to the traveling yarn, as set forth in claim 1, 2, 7, 10, 13, 15 or 16.

* * * * *